US006865275B1

(12) United States Patent
Roeck

(10) Patent No.: US 6,865,275 B1
(45) Date of Patent: Mar. 8, 2005

(54) METHOD TO DETERMINE THE TRANSFER CHARACTERISTIC OF A MICROPHONE SYSTEM, AND MICROPHONE SYSTEM

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/542,036

(22) Filed: Apr. 3, 2000

(30) Foreign Application Priority Data

Mar. 31, 2000 (CH) ..... CHOO/00190

(51) Int. Cl.[7] ..... H04R 3/00
(52) U.S. Cl. ..... 381/92; 381/122
(58) Field of Search ..... 381/92, 97, 94.1, 381/94.9, 58, 56

(56) References Cited

U.S. PATENT DOCUMENTS 4,752,961 A 6/1988 Kahn
5,289,544 A 2/1994 Franklin
5,473,701 A * 12/1995 Cezanne et al. ..... 381/92

FOREIGN PATENT DOCUMENTS

DE 2 242 790 3/1974
DE 197 30 878 A1 1/1998
GB 2 076 152 11/1981

* cited by examiner

*Primary Examiner*—Xu Mei
*Assistant Examiner*—Corey Chau
(74) *Attorney, Agent, or Firm*—Pearne & Gordon LLP

(57) ABSTRACT

Two output signals ($O_{1a}$ and $O_{1b}$) of a microphone system (1) depend in different manner on the angle of incidence (ϕ) of acoustic signals and are divided one by the other (7). A mathematical product of the ratio ($A_7$) and a weighting factor (α) is saturated (12) and subtracted from a signal value (A) which can be fed into the system. The subtraction remainder is multiplied (13) by that output signal from the microphone system (1) which also generates the denominator signal for the division (7). Depending on the weighting factor (a) of the saturation value (B) and on the subtraction value (A), a desired directional characteristic is implemented between the resultant signal ($S_{out}$) of the said multiplication and the angle of incidence (ϕ) of acoustic signals impacting the microphone system (1).

36 Claims, 5 Drawing Sheets

METHOD TO DETERMINE THE TRANSFER CHARACTERISTIC OF A MICROPHONE SYSTEM, AND MICROPHONE SYSTEM

The present invention relates to a method defined in the preamble of claim 1 and to a microphone system defined in claim 9.

When receiving and processing acoustic signals, there is frequently a need to design microphone systems with a transfer characteristic such as to generate the electrical output signal as a predetermined or predeterminable function of the angle of incidence of the acoustic signals. In particular there is a need to design microphone systems with a predetermined or predeterminable directional characteristic such that acoustic signals from certain directional ranges shall be at a higher gain, from other zones at lesser ones, when transforming them into the output signal, and this need extends to systems with a unidirectional receiving characteristic.

Many procedures are known to implement such transfer characteristics. Illustratively the state of the art comprises the patent documents WO99/04598, corresponding to U.S. Ser. No. 09/146,784 (ϕmultiplication) or WO99/09786 corresponding to U.S. Ser. No. 09/168,184 (ϕfilter control) of this applicant, whereby, basically, desired microphone-system transfer characteristics are obtained from the phase shifts of acoustic signals incident on said microphone systems and by appropriately processing of said signals.

The objective of the present invention is to propose another method to implement a desired transfer characteristic in the above-discussed sense.

This problem is solved by the invention by a method of the initially cited kind wherein the microphone system comprises at least two microphone sub-systems of which the transfer characteristics differ in relation to said direction regarding the electric output signals of each, and in that the output signal is formed as a mathematical product which is saturated at a predetermined or predeterminable value, the ratio of the output signals from the said microphone sub-systems being a factor in said product.

The expression "saturation" within the scope of the present invention denotes that the value of a mathematical function under consideration shall be clipped once it has reached a predetermined value and that as a result said value remains constant, contrary to the mathematical function per se.

Even though a low-value saturation of said product, that is of the weighted ratio, may be appropriate, preferably the product shall be saturated at a maximum value.

Moreover the second factor of the saturated product may assume an arbitrary value other than zero, hence also the value of 1.

In another preferred embodiment, the cited function comprises a difference between an adjustable constant and the saturated product, preferably the value of the constant being selected to be at least approximately equal to the saturation value.

Preferably again the cited ratio is obtained from the output-signals' amplitudes without regard to their phases.

In an especially preferred implementation of the method of the invention, the said ratio is used within the following function:

$$S = c_n \cdot \left\{ A - \left[ \alpha \cdot \frac{|c_z|}{|c_n|} \right]_{satB} \right\}$$

where

S is the output signal of the microphone system, A is predetermined or predeterminable signal value, $/c_n/$ is the amplitude of the output signal from a first sub microphone-system of which the transfer characteristic is at a maximum gain at one angle of incidence, the characteristic to be formed also being at maximum gain, $/c_z/$ is the output-signal amplitude of the second sub microphone-system, satB is the ratio saturation at a predetermined or predeterminable maximum signal value B, and $\alpha$ is a predeterminable or predetermined factor.

In an especially preferred implementation of the method of the invention applicable to hearing aids, the transfer characteristics of the sub microphone-systems are selected in such manner that they shall transmit, in substantially mutually opposite directions and at maximum gain, signals from incident acoustic inputs.

A microphone system of the invention and of the initially cited kind is characterized in that the processing unit includes a weighted-ratio forming unit fitted with a denominator input, a numerator input and a weighting input, the numerator and denominator inputs being operationally connected to the input of a processing unit, further the weighted-ratio forming unit which generates an output signal saturated at a maximum and/or a minimum at its output and which is operationally connected to the output of the processing unit.

The method as well as the microphone system of the invention are especially applicable to hearing aids.

Even though the method of the invention and the microphone system of the invention may easily be implemented in the manner of time-domain signal processing, signal processing in a preferred embodiment is carried out in the frequency domain using time-domain/frequency converters or frequency-domain/time-domain converters.

The invention is elucidated below in relation to the Figures of the drawing.

FIGS. 1*a*, 1*b* illustrate the transfer characteristics of two sub microphone-systems "a" and "b" operated in the manner of the invention, FIG. 2 shows the angle ϕ as a coordinate axis in relation to FIGS. 1*a*, 1*b* and, in dB, further the ratio function Q based on the characteristics of FIGS. 1*a* and 1*b*, and also the saturation of the ratio at the maximum value of 0 dB, FIG. 3 is based on the saturated ratio of FIG. 2, also this saturated function as a linear gain scale and the formation of a function F from the difference between said saturated ratio and to a fixed value, FIG. 4 is a view similar to FIGS. 1*a*, 1*b* and shows, in shading, a transfer characteristic of the invention, FIG. 5 is a view similar to FIG. 4 of another transfer characteristic implemented by the invention, and FIG. 6 is a simplified signal-flow and functional block diagram of the implementation of a microphone system of the invention.

Without claiming scientific rigor, the method of the invention shall be represented in FIGS. 1 through 3 by means of simple transfer characteristics, each a cardioid of first order. In the light of this simple method, the expert easily understands how, in the invention, and using more complex transfer functions, a desired transfer characteristic can be attained.

A first sub-microphone system is designed with a three-dimensional transfer characteristic shown in two dimensions in FIG. 1*a* and relating to its transfer or gain features of acoustic signals incident on said system from the direction $\phi$. FIG. 1*b* is similar to FIG. 1*a* of a transfer characteristic of a second sub-microphone system which is assumed mirror-symmetrical to the axis $\pi/2$; $3\pi/2$ of the transfer characteristic of the first sub-microphone system. The transfer characteristics of FIGS. 1*a* and 1*b* respectively are denoted by $c_n$ and $c_z$.

In FIG. 2, the transfer functions $c_n$ and $c_z$ are shown qualitatively and in dB relative to the $\phi$ coordinate axis of FIGS. 1*a* and 1*b*.

As regards the acoustic unit signals incident on the two microphone sub-systems, the transfer characteristics shown in FIGS. 1*a* and 1*b* simultaneously correspond to the signal values at the outputs of the microphone sub-systems under consideration.

In the invention a ratio Q is formed from these two values of output signals, again denoted by $c_n$ and $c_z$, for instance $$Q = \frac{|c_z|}{|c_n|}$$

This ratio leads to the function Q shown qualitatively in dot-dash lines in FIG. 2 with a singularity at $\phi$=n. When the ratio is real, the singularity resulting at the null position of the denominator $|c_n|$ is anyway clipped, that is, the ratio function Q is saturated. Preferably the ratio is saturated at a predetermined or predeterminable value B, preferably as shown in FIG. 3 at the value "1" at the maximum value of the transfer functions of FIGS. 1*a*, 1*b* of "1".

Be it assumed now that the denominator transfer characteristic—in the present case $c_d$—is one at which the desired transfer characteristic be the dominant one, namely a transfer characteristic with a high signal gain in a given angular range wherein the desired characteristic to be implemented also shall have high signal gain, then the advantage of forming the ratio of the invention becomes clear. Said transfer characteristic—which is dominant for the desired result—produces a singularity of the ratio in the angular range around zero. However the zero-point angular range of the dominant transfer characteristic, or of those angular ranges with reduced signal gains shall be those which must be altered, ie to be 'improved' in order to attain the desired characteristic. It is precisely there that the possibility exists for a straightforward intervention, namely by saturating at a predetermined or predeterminable constant ratio value.

For reasons of clarity, the saturated-ratio function $Q_{sat1}$ is shown with a linear gain scale in FIG. 3 at 1. FIG. 3 further shows that in the unsaturated angular ranges, in the present case between 0 and $\frac{1}{2}\pi$ and between $3\pi/2$ and $2\pi$, the saturated ratio $Q_{sat1}$ is a directional transfer-characteristic function. If now specific directional characteristics are desired for the transfer characteristic, then the range of the ratio which was set in the invention to a predetermined saturation value, in this case to 1, shall be used to achieve therein, that is within this angular range, a defined minimum gain in the desired transfer characteristic. This goal is attained in the embodiment being discussed in that the saturated ratio is subtracted from a predetermined or predeterminable fixed value A, in the present illustration for instance and preferably having the value of 1. The result is a function F again shown as a full line in FIG. 3, $$F=A-Q_{satB}$$

or, as a special and preferred case $$F=1-Q_{sat1}.$$

It follows that a transfer function F was attained with a vanishing signal gain except in the range $0 \leqq \phi \leqq \frac{1}{2}\pi$ and $3\pi/2 \leqq \phi \leqq 2\pi$.

The following explanations now can be offered relating to the method of the invention:

Basically the transfer characteristic to be attained is implemented at the output of the microphone system of the invention as a function of a ratio of the output signals from two microphone sub-systems of different transfer characteristics, where said ratio is saturated at a predetermined or predeterminable maximum value.

Preferably and elucidated further below, the ratio function Q is multiplied as one factor with a further predetermined or predeterminable fixed weighting factor before saturation is applied to the resulting mathematical product. Said weighting factor in the example shown in FIGS. 1 through 3 is 1.

It may furthermore be highly advantageous to carry out the saturation on the product of said factor and the ratio, also when reaching predetermined minimum values.

The ratio may be formed directly by dividing the signal amplitudes, irrespective of phase.

Even though the saturated product might be used in the form of another function, generally therefore as:

$$F=F[(\alpha \cdot Q)_{satB}]$$

far more preferably the implementation of a directional characteristic shall be by means of subtracting the said saturated product from a predetermined or predeterminable fixed value.

As elucidated further below, varying the cited fixed value and/or the multiplicative factor $\alpha$ of the saturated product allows, in exceedingly simple manner, to vary the desired directional characteristic.

Basically the sub microphone-systems may be in the form of all known microphones and their combinations, which shall be designed for different transfer characteristics as required by their operating positions and regarding the angle of incidence $\phi$ of acoustic signals.

Sub microphone-systems are preferentially used especially as regards attaining directional characteristics when their transfer characteristics are identical while being directionally mutually opposite as regards the angle of incidence of acoustic signals.

Such microphone systems can be implemented in particular using the known "delay and add" principle.

The above mentioned directionally mutually opposite operational microphone systems can be implemented in particular also when such a system involves two microphones of which the outputs—in a manner shown below—are each time-delayed and are correspondingly added in order to form the two microphone sub-systems.

It is understood that the method of the invention can be expanded using three or more sub microphone-systems in order to attain highly complex transfer functions and combinations of the latter.

In summary, the transfer function preferably used in the invention is shown again, namely $$S = c_d\left[A - \left(\alpha\left\|\frac{|c_n|}{|c_d|}\right)\right\|_{satB}\right].$$

$$S^* = c_n \cdot \left\{1 - \left[4 \cdot \frac{|c_z|}{|c_n|}\right]_{satl}\right\}$$

Figure 6:
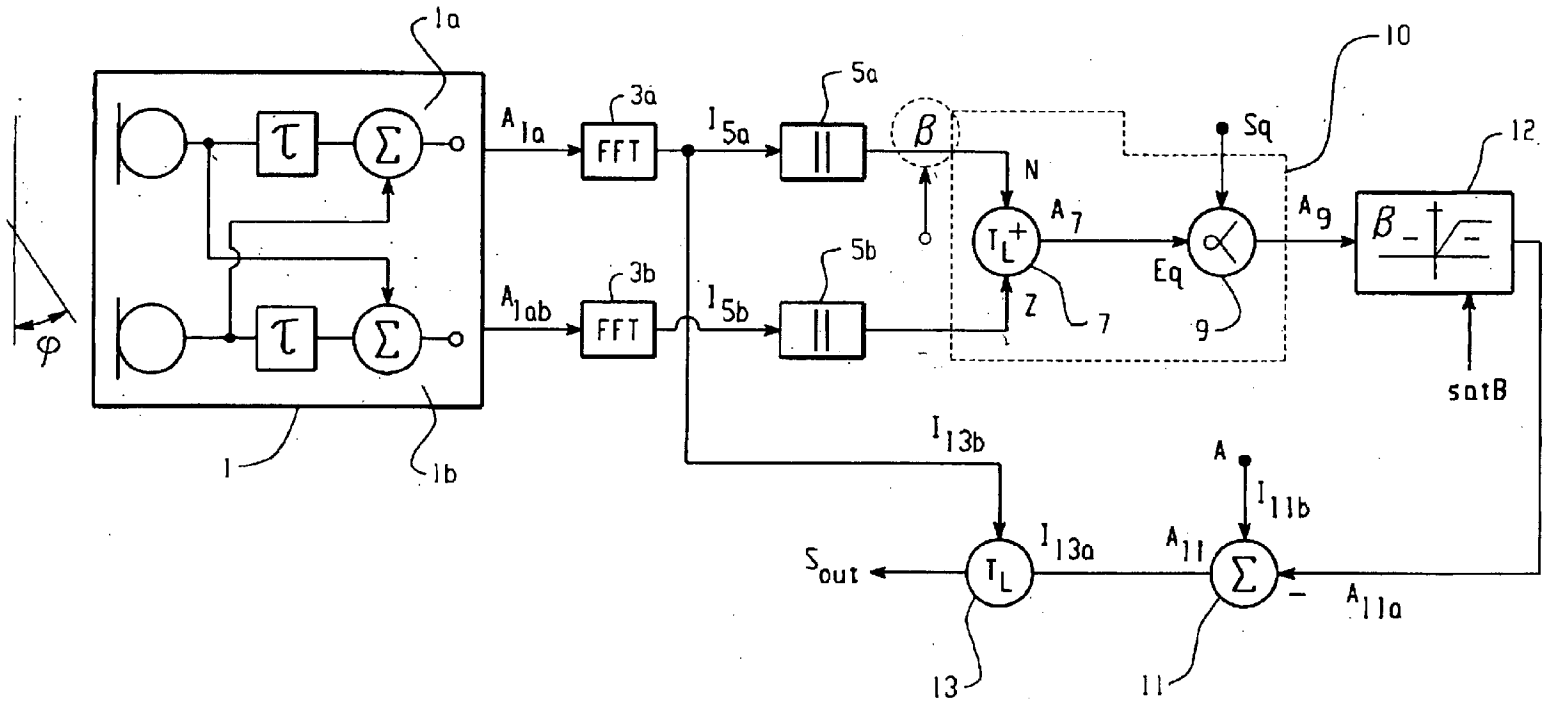

FIG. 6 illustratively shows a microphone system operating in the manner of the method of the invention by means of a simplified signal-flow functional block diagram and especially applicable also to hearing aids.

As shown in FIG. 6, the microphone system comprises at the input side a system 1 with at least two microphone sub-systems 1*a* and 1*b*. The output signals $A_{1a}$ and $A_{1ab}$ at the outputs of said sub-systems are a function of the direction $\phi$ of the acoustic signals incident on the input-side microphones. As shown in FIG. 6, the two sub microphone-systems may consist of a single pair of microphones of which the outputs are coupled to each other in the "delay-and-add" technique. What is essential is that basically the signals at the outputs $A_{1a}$ and $A_{1ab}$ are of different transfer characteristics as regards the acoustic signals incident at an angle $\phi$.

Preferably the output signals $A_{1a}$ and $A_{1ab}$ are fed to time-domain/frequency-domain converter FFT units 3*a* and 3*b* respectively provided and, as preferred, the subsequent signal processing take place in the frequency domain. Said outputs are operationally connected to inputs $I_{5a}$ and $I_{5b}$ respectively of magnitude-forming units 5*a* and 5*b*. The outputs of said magnitude-forming units are, as represented in FIG. 6, fed to the numerator and denominator inputs Z and N, respectively, of a divider unit 7. The output signal $A_7$ is multiplied by a weighting unit 9 by a predeterminable or predetermined weighting factor $\alpha$ present at the control input $S_q$ and is operationally connected to the input $A_{11a}$ of a subtraction unit 11.

As shown in dashed lines in FIG. 6, the divider unit 7 and the weighting unit 9 constitute a weighted ratio-forming unit 10. The factor $\alpha$ which illustratively in FIG. 6 is shown adjustable at the weighting unit 9 may assume values arbitrarily different from 0.

Figure 1A:
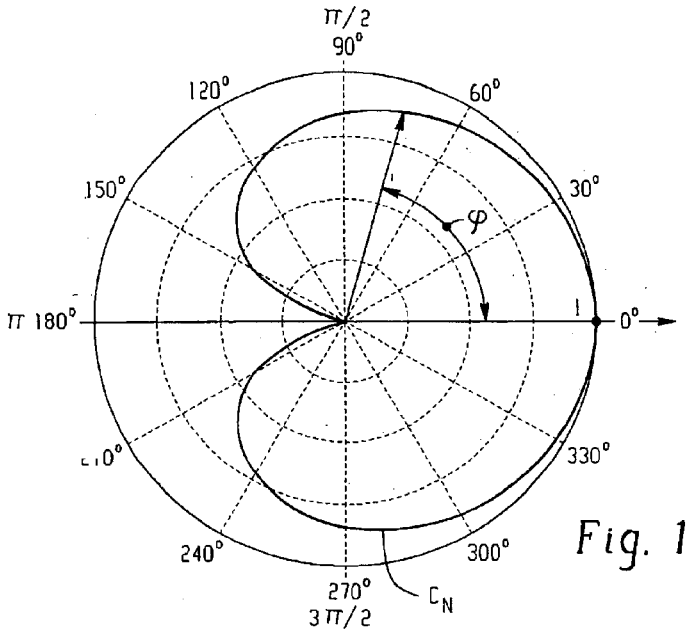
Figure 1B:
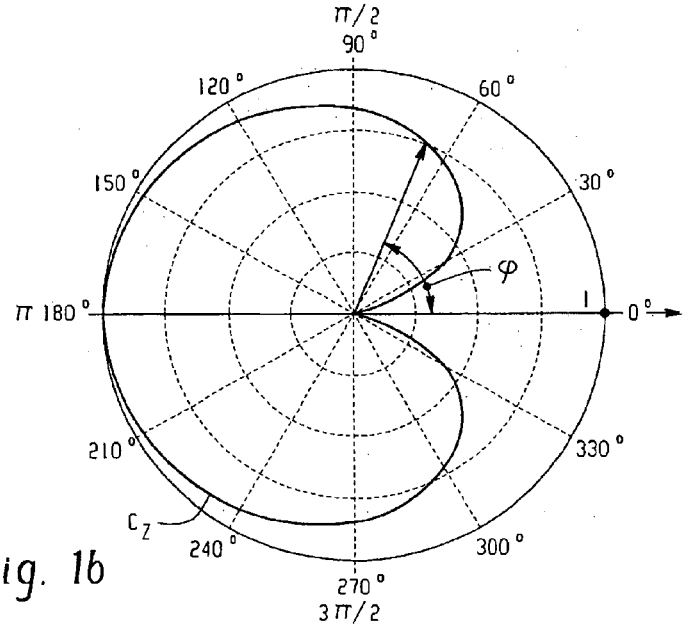
Figure 2:
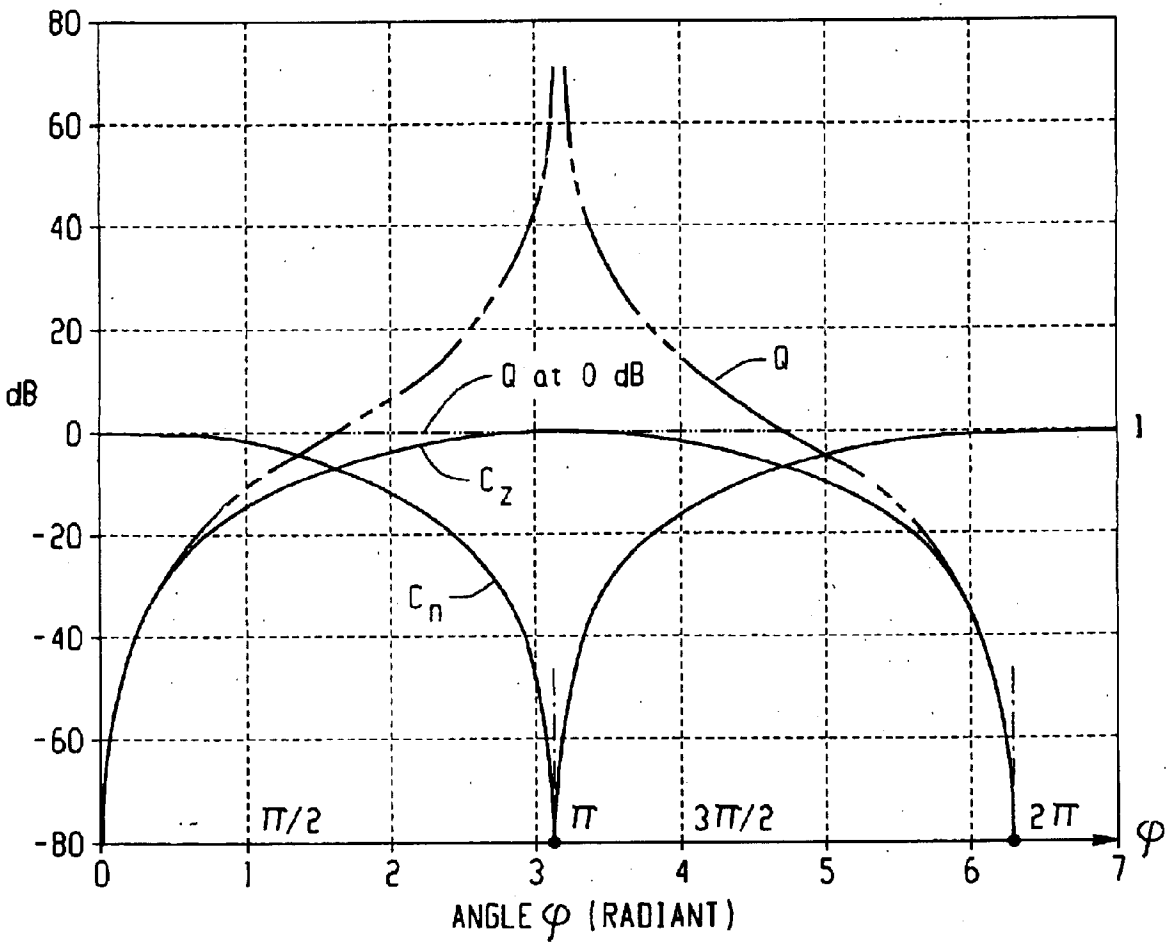
Figure 3:
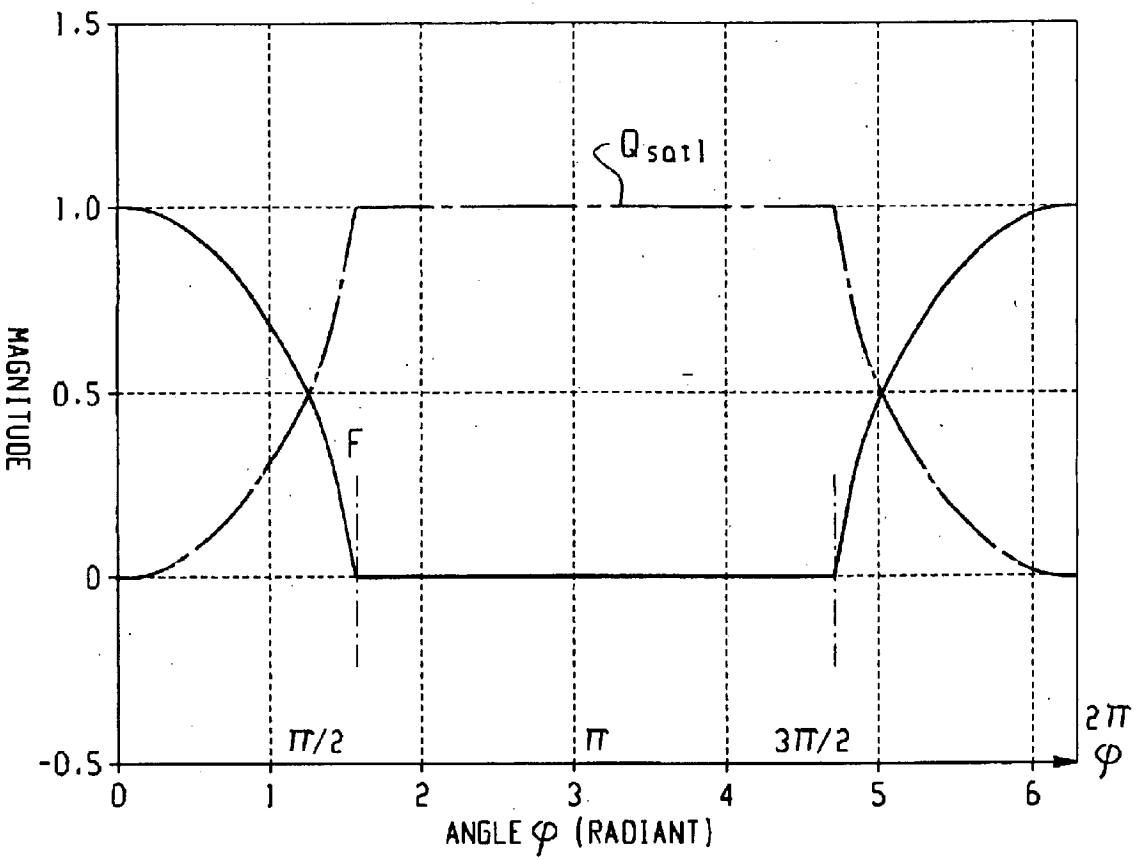

FIG. 6 furthermore diagrammatically shows the signal at the output $A_9$ of the weighted ratio-forming unit 10 being fed to a saturation unit 12 of which the output is first fed to the input $A_{11a}$. The output signal of the weighted ratio-forming unit 10 may be saturated downward at the saturation unit 12—which obviously may be integral with this weighted ratio-forming unit 10—(shown dashed in the block 12 of FIG. 6) and/or upward at a predetermined or predeterminable value B (as schematically indicated at the input "satB". Preferably this setting shall also be at a maximum value. The signal applied to the subtraction unit 11 is subtracted from the fixed value A which is set or can be adjusted at the second input $I_{11b}$. The output signal $A_{11}$ of the subtraction unit 11 is operationally connected to the input $I_{13a}$ of a multiplication unit 13 of which the second input $I_{13b}$ receives the output signal of that microphone sub-system 1*a* which is also applied to the denominator input N of the divider unit 7. If it is desired to change the angular saturation range discussed in FIGS. 1 through 3, then the denominator signal and where called for also the numerator signal, which are fed to the inputs N and Z, respectively, of the divider input 7, may be weighted further.

The output signal $S_{out}$ of the microphone system of the invention appears at the output of the multiplier 13. Said signal includes the desired transfer characteristic as a function of the solid angle $\phi$ at which acoustic signals impinge on the input of the microphone system 1.

As already mentioned, preferably the selected transfer characteristics of the microphone sub-systems 1*a* and 1*b* shall be identical but mutually directionally opposite characteristics. By adjusting the weighting factor $\alpha$, the saturation value B, the fixed value A, and, where called for, further weighting factors such as $\beta$, the desired transfer characteristics shall have been adjusted at the output signal $S_{out}$.

Figure 4:
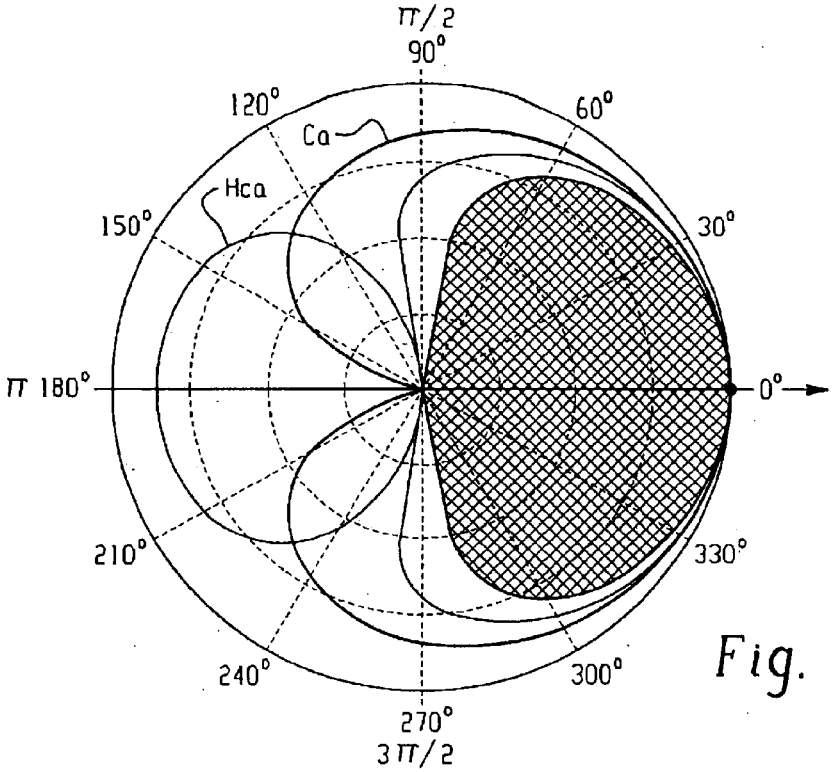
FIG. 4 shows the transfer function constituted by the inversely directional, identical cardioid transfer characteristics Ca of the invention, corresponding to the transfer function $$S' = c_n \cdot \left\{1 - \left[1 \cdot \frac{|c_z|}{|c_n|}\right]_{satl}\right\}$$
Figure 5:
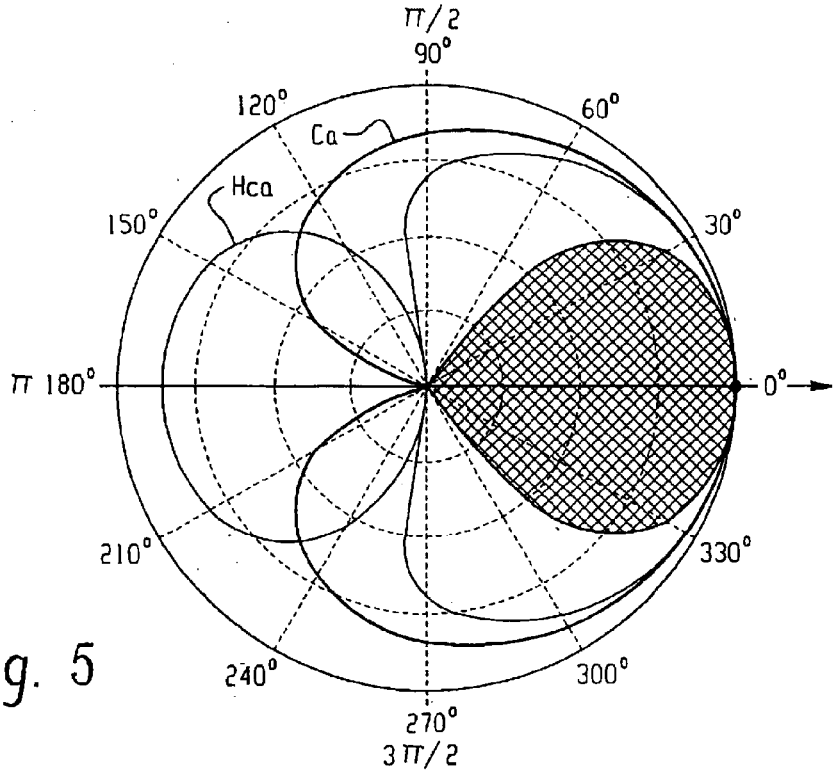
FIG. 5 shows the resultant transfer characteristic where applicable.

The method of the invention and the microphone system of the invention are unusually appropriate for hearing aids, also on account of economical signal processing and, as shown by FIGS. 5 and 4, the remarkable ability to suppress signal transmission from undesired directions of incidence, for instance to the rear of a hearing aid. As regards hearing aids, preferably the microphone sub-systems having cardioid characteristics Ca shall be replaced with sub-systems having hypercardioid characteristics Hca (FIG. 5).

What is claimed is:

1. A method for establishing a desired transfer characteristic which converts an acoustical input signal impinging on a microphone arrangement into an electric output signal as a function of the angle at which said acoustical input signals impinge on said microphone arrangement, said method comprising the steps of:

providing at said microphone arrangement a first microphone sub-arrangement and a second microphone sub-arrangement, each microphone sub-arrangement having a transfer characteristic which converts said acoustical input signal impinging on said microphone sub-arrangements into an electric output signal of the respective sub-arrangement, said transfer characteristics of said first microphone sub-arrangements being different from said transfer characteristic of said second microphone sub-arrangement with respect to said acoustical input signal;

forming a ratio of said output signals of said first and second microphone sub-arrangements, thereby generating a ratio result;

forming a saturated product with said ratio result as one factor, thereby clipping said product at a predetermined or predeterminable value and generating a saturated product result; and generating said electric output signal as a function of said saturated product result.

2. The method of claim 1, further comprising the step of saturating said product on a maximum value.

3. The method of claim 1, further comprising the step of forming said saturated product with a second factor having an arbitrary value different from 0.

4. The method of claim 1, wherein said function of said saturated product result comprises a difference function of a constant value and said saturated product result.

5. The method of claim 4, wherein said constant value is selected to be adjustable.

6. The method of claim 4, further comprising the step of saturating said saturated product on a saturation value and selecting said constant to be at least substantially equal with said saturation value.

7. The method of claim 1, further comprising the step of forming said ratio from the amplitude values of said output signals of said sub-arrangements.

8. The method of claim 1, further comprising generating said electric output signal according to the equation:

$$S = c_n \cdot \left\{ A - \left[ \alpha \cdot \frac{|c_z|}{|c_n|} \right]_{satB} \right\}$$

wherein:

S is said electric output signal,

A is a predetermined or adjusted value, $|c_n|$ is the amplitude value of the output signal of one of said sub-microphone arrangements, the transfer characteristic of which has maximum gain for a value of said angle at which said desired transfer characteristic shall have maximum gain as well, $|c_z|$ is the amplitude value of the other of said at least two sub-microphone arrangements, satB is the saturation of the product to a predetermined or adjusted minimum or maximum value B, and $\alpha$ is a predetermined or adjustable factor.

9. The method of claim 1 further comprising the step of selecting said transfer characteristics of said at microphone sub-arrangements to have respectively a maximum gain for acoustical signal impinging on substantially opposite directions.

10. The method of claim 1, further comprising selecting said transfer characteristics of said microphone sub-arrangements to be generally of cardioid shape in polar diagram representation.

11. The method of claim 1, further comprising selecting said transfer characteristics of said microphone sub-arrangements to be generally of hyper-cardioid shape in polar diagram representation.

12. The method of claim 1 for establishing a desired transfer characteristic of a hearing device.

13. The method of claim 1 for establishing a desired transfer characteristic for a hearing aid device.

14. A microphone arrangement comprising:

two microphone sub-arrangements each having an output, each of said microphone sub-arrangements also having a respective transfer characteristic with which acoustical input signal impinging on said microphone sub-arrangements are converted into respective electrical output signals at said outputs as a function of the angle at which said acoustical input signals impinge on said microphone sub-arrangements, said transfer characteristics of said microphone sub-arrangements being different with respect to said acoustical input signal;

a computing unit having at least two inputs and an output, said outputs of said microphone sub-arrangements being respectively operationally connected to said inputs of said computing unit, said computing unit including:

a ratio forming and weighing unit having an output, a denominator input, a numerator input and a weighing input, wherein one of said inputs of said computing unit is operationally connected to said denominator input, and wherein the other of said inputs of said computing unit is operationally connected with said numerator input, and further wherein said ratio forming and weighing unit generates at said output an output signal saturated at a maximum and/or minimum value, the output of said ratio forming and weighing unit being operationally connected to the output of said microphone arrangement.

15. The arrangement of claim 14, wherein the output signal of said ratio forming and weighing unit is saturated on a maximum signal value.

16. The arrangement of claim 14, wherein said weighing input of said ratio forming and weighing unit is set with a signal representing a weighing factor different from zero which is predetermined or adjustable.

17. The arrangement of claim 14, wherein the output of said ratio forming and weighing unit is operationally connected to said output of said computing unit via a difference forming unit.

18. The arrangement of claim 17, wherein said difference forming unit has a first input operationally connected to the output of said ratio forming and weighing unit and has a second input for a predetermined or adjustable signal.

19. The arrangement of claim 18, wherein the value of said predetermined or adjustable signal is at least substantially equal to a value at which the output signal of said ratio forming and weighing unit is saturated.

20. The arrangement of claim 17, wherein the output of said difference forming unit is operationally connected to an input of a multiplication unit having two inputs and an output, the second input being operationally connected to the output of the microphone sub-arrangement, the output of which is operationally connected to said denominator input, the output of said multiplication unit being operationally connected to the output of said computing unit.

21. The arrangement of claim 14, wherein said inputs of said computing unit are operationally connected respectively to said denominator and numerator inputs of said ratio forming and weighing unit via magnitude forming units.

22. The arrangement of claim 14, wherein said output of said ratio forming and weighing unit is operationally connected to one input of a multiplication unit having at least two inputs and an output, the second input of said multiplication unit being operationally connected to the output of the microphone sub-arrangement, the output of which is operationally connected to said denominator input, said output of said multiplication unit being operationally connected to said output of said computing unit.

23. The arrangement of claim 14 further comprising time to frequency converter units interconnected between said outputs of said microphone sub-arrangements and said inputs of said computing unit.

24. The arrangement of claim 14, wherein said microphone sub-arrangements have respective transfer characteristics with a cardioid shape in polar representation.

25. The arrangement of claim 14, wherein said microphone sub-arrangements have respective transfer characteristics with a hyper-cardioid shape in polar representation.

26. The arrangement of claim 14 being part of a hearing device.

27. The arrangement of claim 14 being part of a hearing aid device.

28. A method for establishing a desired transfer characteristic which converts acoustical input signals impinging on a microphone arrangement into an electric output signal as a function of the angle at which said acoustical input signals impinge on said microphone arrangement, said method comprising the steps of:

providing at said microphone arrangement at least two microphone sub-arrangements, each microphone sub-arrangement having a transfer characteristic which converts said acoustical input signals impinging on said microphone sub-arrangements into an electric output signal of a respective sub-arrangement, said transfer characteristics of said at least two microphone sub-arrangements being different;

forming a ratio of said output signals of said at least two sub-arrangements, thereby generating a ratio result;

forming a saturated product with said ratio result as one factor, thereby performing saturating said product at a predetermined or predeterminable value and generating a saturated product result;

generating said electric output signal as a function of said saturated product result.

29. A microphone arrangement comprising:

a first microphone sub-arrangement having a first output in the time domain having a first transfer characteristic with respect to an impinging acoustic signal;

a second microphone sub-arrangement having a second output in the time domain having a second transfer characteristic with respect to an impinging acoustic signal, wherein said first transfer characteristic and said second transfer characteristic are different;

a first time to frequency converter unit for converting said first output into a first frequency domain signal;

a second time to frequency converter unit for converting said second output into a second frequency domain signal;

a computing unit having a first input, a second input, and an output, wherein said frequency domain signals of said time to frequency converter units are connected to said inputs of said computing unit, respectively, wherein said computing unit generates a ratio signal that is proportional to an amplitude or an absolute value of one of said first and second frequency domain signals, and further wherein said ratio signal is inversely proportional to an amplitude or an absolute value of the other of said first and second frequency domain signals, and still further wherein said ratio forming and weighing unit multiplies said ratio signal by a non-zero value to create a weighted ratio; and wherein said ratio forming and weighing unit generates a saturated signal by clipping said weighted ratio at a maximum and/or minimum value.

30. The microphone arrangement of claim 29, wherein said computer unit further generates a difference signal by subtracting said saturated signal from a constant.

31. The microphone arrangement of claim 30, wherein said computer unit further generates an output signal by multiplying said difference signal by one or the other of said first and said second frequency signals.

32. The microphone arrangement of claim 30, wherein said computer unit further generates an output signal by multiplying said difference signal by the other of said first and second frequency domain signals.

33. A method for establishing a desired transfer characteristic which converts an acoustical input signal impinging on a microphone arrangement into an electric output signal as a function of the angle at which said acoustical input signals impinge on said microphone arrangement, said method comprising the steps of:

at said microphone arrangement providing:

a first microphone sub-arrangement having a transfer characteristic which converts said acoustical input signal impinging on said first microphone into an output signal represented by $c_n$; and a second microphone sub-arrangement having a transfer characteristic which converts said acoustical input signal impinging on said second microphone into an output signal represented by $c_z$; and generating said electric output signal according to the equation:

$$S = c_n \cdot \left\{ A - \left[ \alpha \cdot \frac{|c_z|}{|c_n|} \right]_{satB} \right\}$$

wherein:

S is said electric output signal,

A is a predetermined or adjusted value, $|c_n|$ is the amplitude value of the output signal $c_n$, $|c_z|$ is the amplitude value of the output signal $c_z$, satB is the saturation of the product ([] to a predetermined or adjusted minimum or maximum value B, and $\alpha$ is a predetermined or adjustable factor.

34. The method of claim 33 wherein the transfer characteristic of the first microphone sub-arrangement has maximum gain for a value of said angle at which said desired transfer characteristic shall have maximum gain as well.

35. A microphone arrangement implementing the method of claim 34.

36. A microphone arrangement implementing the method of claim 33.

* * * * *

UNITED STATES PATENT AND TRADEMARK OFFICE

CERTIFICATE OF CORRECTION

PATENT NO. : 6,865,275 B1
DATED : March 8, 2005
INVENTOR(S) : Hans-Ueli Roeck

It is certified that error appears in the above-identified patent and that said Letters Patent is hereby corrected as shown below:

Title page,
Item [30], Foreign Application Priority Data, please delete "March 31, 2000 (CH) CHOO/00190" and insert therefore -- March 31, 2000 (WO) PCT/CHOO/00190 --.

Column 1,
Line 25, please insert a space between "ϕ" and the word "multiplication".

Column 4,
Line 26, please insert a space between "ϕ" and the word "filter".

Column 3,
Line 23, please delete the "n" and insert therefor -- π --.

Column 7,
Line 17, please delete "product to" and insert therefor -- product [ ] to --.
Line 21, please delete "at".

Column 10,
Line 36, please delete "([ ]" and insert therefore -- [] --.

Signed and Sealed this

Twenty-third Day of August, 2005

JON W. DUDAS
*Director of the United States Patent and Trademark Office*